US007179101B2

(12) United States Patent
Murakami et al.

(10) Patent No.: US 7,179,101 B2
(45) Date of Patent: Feb. 20, 2007

(54) JOINT BOX FOR CONNECTING ELECTRICAL WIRES

(75) Inventors: Yoshihiro Murakami, Aichi (JP); Kunihiko Sato, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/109,770

(22) Filed: Apr. 20, 2005

(65) Prior Publication Data

US 2005/0260874 A1 Nov. 24, 2005

(30) Foreign Application Priority Data

May 20, 2004 (JP) ..... 2004-150774
May 20, 2004 (JP) ..... 2004-151026

(51) Int. Cl.
*H01R 13/44* (2006.01)

(52) U.S. Cl. ..... 439/142; 439/407; 439/413

(58) Field of Classification Search ..... 439/402, 439/407–408, 413, 142
See application file for complete search history.

(56) References Cited

U.S. PATENT DOCUMENTS 4,023,883 A 5/1977 Raposa et al. ..... 339/98
4,944,689 A * 7/1990 Carr ..... 439/417
5,690,505 A 11/1997 Hirata ..... 439/402
6,065,993 A * 5/2000 Lai et al. ..... 439/402
6,769,931 B2 * 8/2004 Negishi et al. ..... 439/404

FOREIGN PATENT DOCUMENTS

JP 10-285742 10/1998
JP 11-191446 7/1999
JP 2001-155792 6/2001

OTHER PUBLICATIONS

European Search Report, dated Aug. 25, 2005, received on corresponding European patent application, 3 pages.

* cited by examiner

*Primary Examiner*—Truc Nguyen
(74) *Attorney, Agent, or Firm*—Armstrong, Kratz, Quintos, Hanson & Brooks, LLP

(57) ABSTRACT

To provide a joint box, which can easily and compactly hold electrical wires along the joint box, the joint box includes a base unit having separately a joint portion for connecting electrical wires and a wire bundle portion for passing the electrical wires and a cover mounted on the base unit for covering the joint portion and the wire bundle portion. The cover includes integrally a first cover portion for the joint portion and a second cover portion for the wire bundle portion. At least one of terminals at the joint portion is connected with an earth ground terminal. The electrical wires are wired at the wire bundle portion of the joint box.

20 Claims, 8 Drawing Sheets

6

JOINT BOX FOR CONNECTING ELECTRICAL WIRES

The priority application Number Japan Patent Application No. 2004-150774 and 2004-151026 upon which these patent applications are based is hereby incorporated by reference.

BACKGROUND OF THE INVENTION

1. Field of the Invention

This invention relates to a joint box, which includes a joint portion for connecting electrical wires with each other by pressure-contact terminals and a wire bundle portion for passing the electric wires therethrough not to connect the electrical wires by pressure contact, and an electrical wire bundling structure by the joint box.

2. Description of the Related Art

FIG. 12 shows an embodiment of a joint box by prior art (see Reference Patent 1).

A joint box 51 includes a main box body 52 made of synthetic resin and a cover 54 covering a top opening 53 of the main box body 52. The cover 54 is formed through a thin hinge integrally with the main box body 52. Pressure-contact terminals 55 are provided in the main box body 52. The cover 54 is provided with projections 56 corresponding to the pressure-contact terminals 55 for pressing the electrical wires.

The cover 54 moves around the hinge between a position of opening the main box body 52 and a position of covering the main box body 52. The cover 54 has a lock hole 74 and the main box body 52 has a lock projection 75. The lock hole 74 and the lock projection 75 are engaged with each other when the cover 54 covers the main box body 52.

In the embodiment, an electrical wire 57 with a male terminal (FIG. 13) is connected by pressure contact with the pressure-contact terminal 55. The male terminal (not shown) projects from a front opening (not shown) of the main box body 52, and is locked in a connector housing to be press-fitted with the front opening so as to structure a connector.

As shown in FIG. 13, two pressure-contact terminals 55 in the main box body 52 are arranged in parallel, and connected with each other by a horizontal connecting plate 58 so as to form a bus bar 59 for joining electrical wires 57. Two electrical wires 57 are joined with each other through the bus bar 59. Joining points (pressure-contact points) of the pressure-contact terminals 55 and the electrical wires 57 are covered by the cover 54 (FIG. 12) for protection.

FIG. 14 shows the other embodiment of the joint box by prior art (see Reference Patent 2)

A joint box 61 includes a main box body 62 and a cover 63 made of synthetic resin, a bus bar 64 provided in the main box body 62, and an earth ground terminal 65 integrally continued to the bus bar 64 and projecting out of the main box body 62.

The bus bar 64 has a plurality of pressure-contact terminals 66. Each electrical wire 67 is press-fitted into each pressure-contact terminal 66 and led from the both sides of the main box body 62 to an outside thereof. Each end of the electrical wires 67 is provided with a connector to be connected with an apparatus. The earth ground terminal 65 is screwed on a vehicle body so that each electrical wire 67 is joined by the bus bar 64 for grounding it to the vehicle body.

Reference Patents are:

Reference Patent 1, Japan Patent Application No. H11-191446;

Reference Patent 2, Japan Patent Application No. 2001-155792; and

Reference Patent 3, Japan Patent Application No. H10-285742.

The joint box 51, 61 by prior art can protect pressure-contact points of the electrical wires 57, 67 by the cover 54, 63. However, when there are electrical wires wired along the joint box 51, 61 other than the electrical wires to be pressure-contacted, or lead-out electrical wires, which are pressure-contacted already, to be folded into U-shape, the other component, such as a harness protector and a band clamp, is required for supporting the electrical wires and protecting them. Therefore, there are problems of an extra cost of the other component and additional operation for bundling the electrical wires.

For placing electrical wires 57, 67 with a connector at an end thereof in the joint box 51, 61 without folding into U-shape, pressure-contact terminals for pressure-contacting other electrical wires extending in a direction of folding are required. Therefore, cost-up by additional pressure-contact terminals and connecting operation arises.

In the joint box 51 having the main box body 52 and the cover 54 formed through the thin hinge integrally with the main box body 52, when the hinge is broken off, lock of the lock hole 74 and the lock projection 75 is unlocked and the cover 54 is fallen out of the main box body 52. Therefore, the terminals and electrical wires received in the joint box 51 are exposed possibly to contact to other apparatuses or short to each other or cause unstable contact of the terminal and the wires.

SUMMARY OD THE INVENTION

Objects to be Solved

To overcome the above problem, object of this invention is to provide a joint box, which can bundle pressure contacted electrical wires and electrical wires not to be pressure-contacted easily and securely and furthermore can prevent a cover from falling out of a main box body when a hinge is broken off, and a wire bundling structure by using the joint box.

How to Attain the Object of the Present Invention

In order to attain the object of the present invention, a joint box according to an aspect of the present invention includes a base unit having separately a joint portion for connecting electrical wires with each other and a wire bundle portion for passing the electric wires therethrough to bundle the electrical wires and a cover mounted on the base unit for covering the joint portion and the wire bundle portion.

According to the above structure, a plurality of electrical wires is connected with each terminal for joining wires at the joining portion, and each terminal is connected through a bus bar. Thereby, respective electrical wires are joined through the terminals. The wire bundle portion separated from the joint portion is formed integrally. Electrical wires other than that to be joined are passed through the wire bundle portion, or the electrical wires to be joined are folded and passed with the electrical wires other than that to be joined. The cover covers the joint portion to protect joint point of the electrical wire and the terminal at the joint portion and the wire bundle portion to bundle (hold) the electrical wires at the wire bundle portion. Respective electrical wires are positioned and secured (held) at the wire bundle portion.

The joint box according to another aspect of the present invention is specified in the aforesaid joint box by that the cover includes integrally a first cover portion corresponding to the joint portion and a second cover portion corresponding to the wire bundle portion.

According to the above structure, the first cover portion and the second cover portion are formed integrally. Comparing the joint box, which a cover for the joint portion and a cover for the wire bundle portion are separated, number of components is reduced and operation of mounting covers is reduced. When the first cover portion and the second cover portion are connected through a flexible hinge, after the electrical wires are joined at the joint portion and the first cover portion is closed, the electrical wire can be passed through the wire bundle portion and the second cover portion can be closed. Thereby, joining electrical wires can be securely and efficiently without a disturbance by the electrical wires at the wire bundle portion.

The joint box according to a further aspect of the present invention is specified in the aforesaid joint box by that the base unit includes a main box body having a bottom wall for positioning the electrical wires thereon, a side wall extending vertically from the bottom wall, a first lock projection projecting from an outer surface of the side wall along a surface of the bottom wall and a second lock projection projecting from an edge of the side wall at remote side from the bottom wall along a surface of the side wall, and the cover includes a first lock portion for engaging with the first lock projection and a second lock portion for engaging with the second lock projection.

According to the above structure, a direction in which the first lock projection extends from (the outer surface of) the side wall and a direction in which the second lock projection extends from (the edge of) the side wall intersect with each other so that, when the hinge is broken off, locking of the lock hole and the lock projection is maintained. Thus, even if the hinge is broken off, the cover portions of the cover are continuously mounted on the main box body so that it is prevented that the cover portions are fallen out of the main box body.

The joint box according to a further aspect of the present invention is specified in the aforesaid joint box by that the inner surface of the second lock projection intersects with the surface of the first lock projection in the vicinity of the bottom wall.

According to the above structure, the inner surface of the second lock projection intersects with the surface of the first lock projection in the vicinity of the bottom wall. Thereby, when the hinge is broken off, the cover portions of the cover are continuously mounted on the main box body so that it is prevented that the cover portions are fallen out of the main box body.

The joint box according to a further aspect of the present invention is specified in the aforesaid joint box by that the outer surface of the second lock projection is tapered gradually toward the inner surface thereof in accordance with a distance from the bottom wall.

According to the above structure, the outer surface of the second lock projection is tapered gradually toward the inner surface thereof in accordance with a distance from the bottom wall so that the cover can be mounted easily on the main box body.

The joint box according to a further aspect of the present invention is specified in the aforesaid joint box by that at least one terminal of the joint portion is connected with an earth ground terminal.

According to the above structure, respective electrical wires are connected with each terminal for joining the wires, and at least one terminal (called a first terminal) is connected with the earth ground terminal. Thereby, the electrical wire connected with the first terminal is earth grounded to outside through the earth ground terminal. The first terminal functions as a negative electrode. The other terminal not earth grounded, called a second terminal, functions as a positive electrode. The electrical wire connected with the first terminal is connected as the negative electrode and the electrical wire connected with the second terminal is connected as the positive electrode through a connector to an apparatus.

An electrical wire bundling structure according to an aspect of the present invention including the aforesaid joint box is specified by that the electrical wires are bundled at the wire bundle portion.

According to the above structure, the electrical wires other than that to be joined are passed through the wire bundle portion, or the electrical wires to be joined are folded and passed with the electrical wires other than that to be joined. The cover covers the joint portion to protect joint point of the electrical wire and the terminal at the joint portion and the wire bundle portion to bundle (hold) the electrical wires at the wire bundle portion. Respective electrical wires are positioned and secured (held) at the wire bundle portion.

The electrical wire bundling structure according to a further aspect of the present invention is further specified in the aforesaid electrical wire bundling structure by that the electrical wires connected with the terminal of the joint portion are folded into U-shape and passed through the wire bundle portion.

According to the above structure, an end of the electrical wires connected with the terminal of the joint portion are folded and led through the wire bundle portion to the same direction as the other end of the electrical wire. The one end of the electrical wire is positioned and held at the wire bundle portion. The one end and the other end of the electrical wire are connected with each terminal in respective connectors or in the same connector, and connected with an apparatus through the connector. In a usual joint box by prior art, for leading the electrical wire in the same direction against one electrical wire, the other electrical wire and a terminal for connecting the electrical wire are required. According to the structure of the present invention, the other electrical wire and a terminal for connecting the electrical wire are not required, so that a joint circuit can be formed with smaller number (wire product number) of electrical wires.

Effect of the Invention

According to the aspect of the present invention, the electrical wires not to be joined can be positioned and held together with the joined electrical wire in the joint box without another component, such as the harness protector, and the band clamp. Cost of the another component can be reduced. Operation of passing and holding the electrical wire through the another component, and fixing the another component on the vehicle body is not required, so that operation of wiring electrical wires in a vehicle is made more effective.

According to the aspect of the present invention, the cover forming the first cover portion and the second cover portion integrally reduces component cost. After the electrical wires are joined at the joint portion and the first cover portion is closed, the electrical wire can be passed through the wire bundle portion and the second cover portion can be closed.

Thereby, joining electrical wires can be securely and efficiently without a disturbance by the electrical wires at the wire bundle portion and reliability of electrical connection of the joint box can be improved.

According to the aspect of the present invention, a direction in which the first lock projection extends from (the outer surface of) the side wall and a direction in which the second lock projection extends from (the edge of) the side wall intersect with each other so that, when the hinge is broken off, locking of the lock hole and the lock projection is maintained. Thus, even if the hinge is broken off, the cover portions of the cover are continuously mounted on the main box body so that it is prevented that the cover portions are fallen out of the main box body.

According to the aspect of the present invention, the inner surface of the second lock projection intersects with the surface of the first lock projection in the vicinity of the bottom wall. Thereby, when the hinge is broken off, the cover portions of the cover are continuously mounted on the main box body so that it is prevented that the cover portions are fallen out of the main box body.

According to aspect of the present invention, the outer surface of the second lock projection is tapered gradually toward the inner surface thereof in accordance with a distance from the bottom wall so that the cover can be mounted easily on the main box body.

According to aspect of the present invention, the joint box has the earth ground terminal so that the joined electrical wires can be connected easily with an earth circuit.

According to the aspect of the present invention, the electrical wires not to be joined can be positioned and held together with the joined electrical wire in the joint box without another component, such as the harness protector, and the band clamp. Cost of the another component can be reduced. Operation of passing and holding the electrical wire through the another component, and fixing the another component on the vehicle body is not required, so that operation of wiring electrical wires in the vehicle is made more effective.

According to the aspect of the present invention, another component for bundling the electrical wires is not required. Comparing the joint box by prior art, numbers of the electrical wires, types thereof and terminals for joining are reduced so that the joint box size is miniaturized and the cost is reduced.

The above and other objects and features of this invention will become more apparent from the following description taken in conjunction with the accompanying-drawings.

DESCRIPTION OF THE PREFERRED EMBODIMENT

Figure 1:
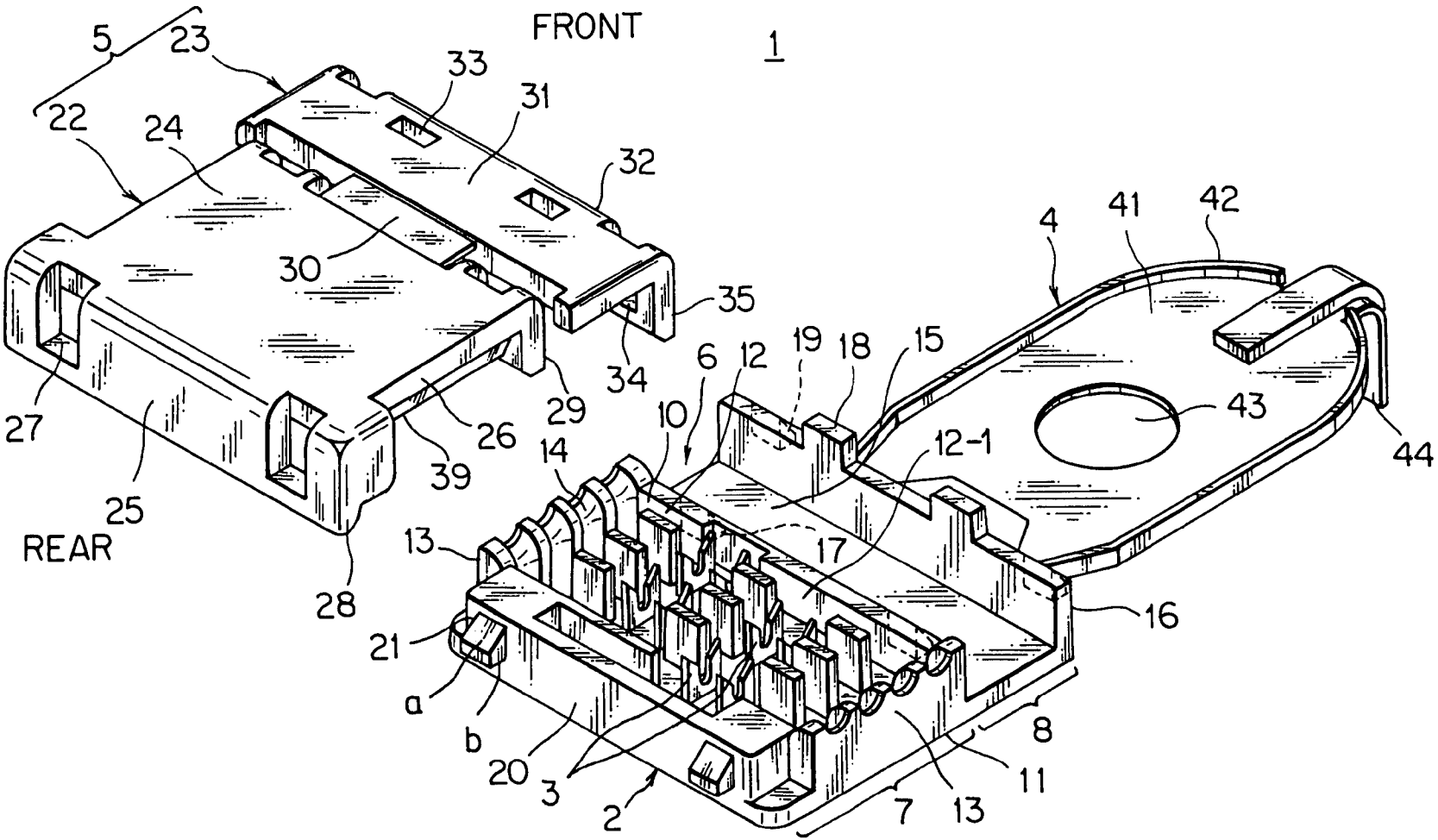
FIG. 1 is an exploded perspective view of an embodiment of a joint box according to the present invention.
Figure 2:
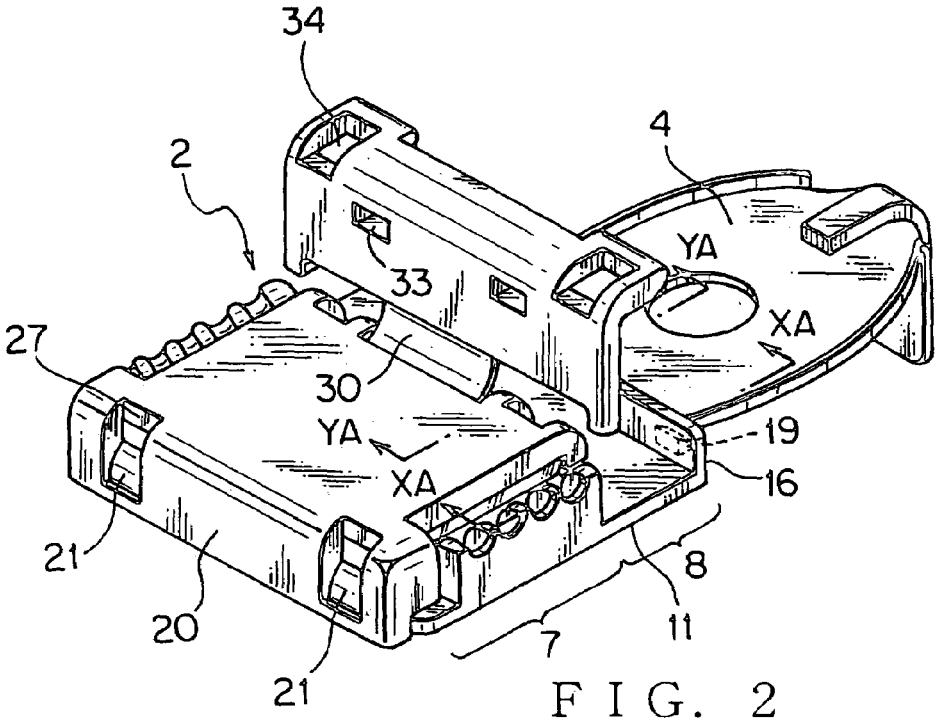
FIG. 2 is a perspective view of the joint box shown in FIG. 1.
Figure 3:
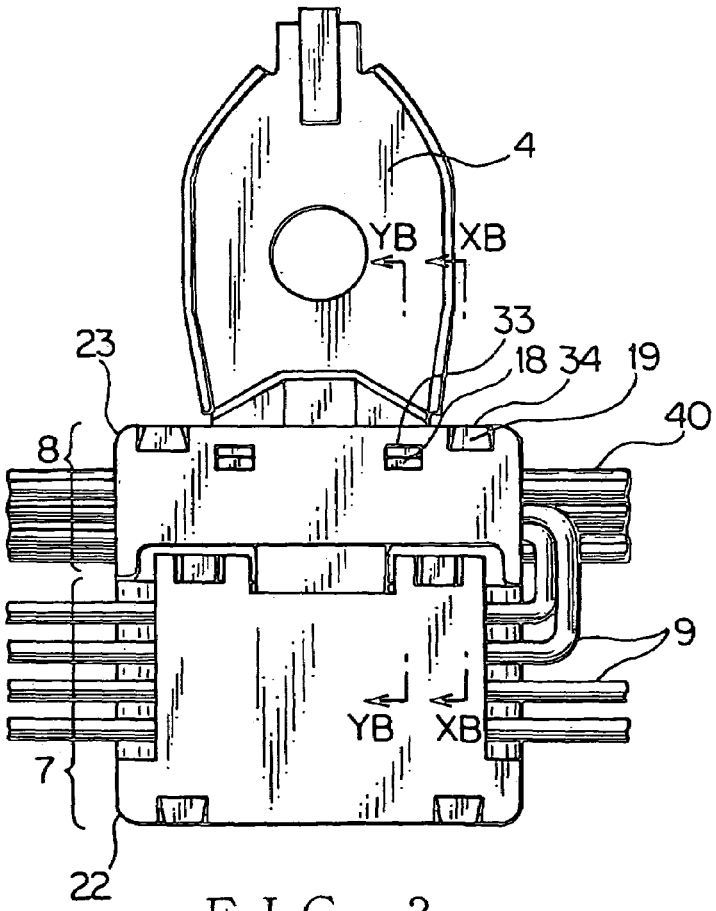
FIG. 3 is a plan view of the joint box shown in FIG. 1.

FIG. 1 shows one embodiment of a joint box according to the present invention.

A joint box 1 includes a main box body 2 made of synthetic resin, a plurality of pressure-contact terminals 3 arranged in the main box body 2, a plurality of electric conductive metal bus bars formed by connecting the predetermined terminals with each other with a horizontal connecting plate (not shown), an earth ground terminal 4 being continued to a bus bar (not shown) at earth ground side, and a cover 5 made of synthetic resin for covering the main box body 2.

A base unit 6 is structured with the main box body 2 and the bus bars including the pressure-contact terminals. The base unit 6 is divided into a joint portion 7 including the pressure-contact terminals 3 at a rear half thereof and a wire bundle portion 8 without the pressure-contact terminals 3 at a front half thereof. In this embodiment, a front side is defined as a side of the earth ground terminal 4.

Figure 9:
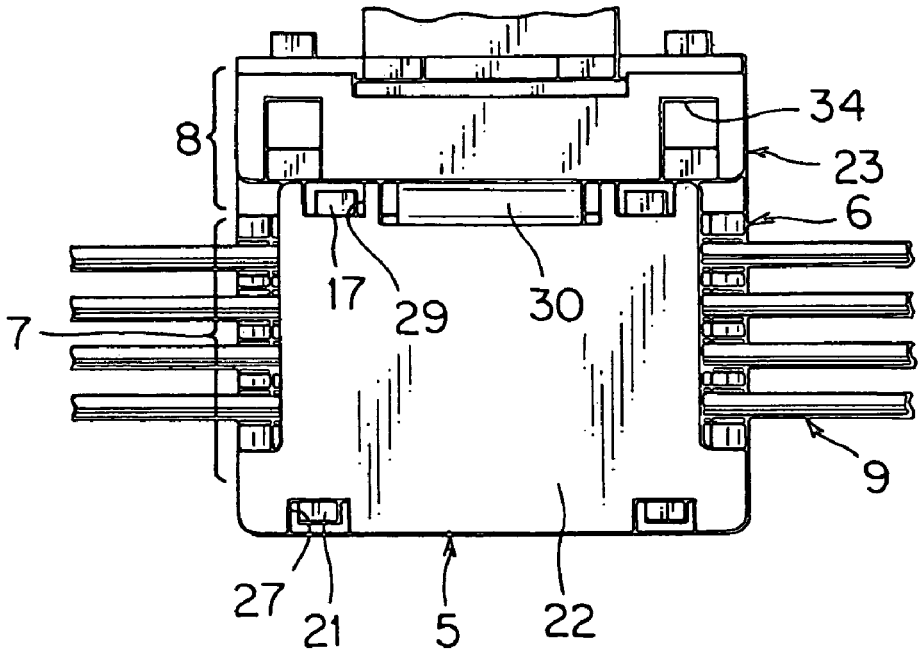
FIG. 9 is a plan view of the base unit covered by a first cover portion of a cover.

The joint portion 7 has a groove 10 for arranging respective electrical wires 9 (FIG. 9) in parallel and pressure-contact terminals 3 placed in the groove 10. The groove 10 is formed by surrounding with a bottom wall 11 of the main box body 2, a partition wall standing vertically from the bottom wall 11. The pressure-contact terminals 3 are fixed in the partition wall 12 by insert molding. The horizontal connecting plate (not shown) of the bus bar is molded inside the bottom wall 11 of the main box body 2 by insert molding. Both of side walls 13 are formed vertically at both ends in a direction of lengthwise of the groove 10. A half-round wire lead-out 14 is formed at a top end of the both side walls 13.

The wire bundle portion 8 of the base unit 6 includes a wide rectangular gutter 15 (space) parallel to the groove 10 of the joint portion 7. The gutter 15 is surrounded with the partition wall 12-1 at the front end of the joint portion 7, the bottom wall 11 of the main box body 2 and a vertical front wall 16 at the earth ground terminal side.

The partition wall 12-1 is provided with a pair of right-and-left lock projections 17 corresponding to the cover 5, projecting to an inside of the gutter 15. A pair of right-and-left second lock projections 18 is provided at a top edge of the front wall 16 at a front end to project upwardly. A pair of right-and-left first lock projections 19 is provided at an outer surface of the front wall 16. A pair of lock projections 21 is provided on a rear wall 20 at a rear end of the joint portion 7 symmetrically against the lock projections 17 of the partition wall 12-1. The cover 5 is locked with the six lock projections 17, 19, 21. Respective lock projections 17, 19, 21 have a slant surface "a" at a top side thereof and a lock surface "b" at a bottom side thereof.

Figure 4A:
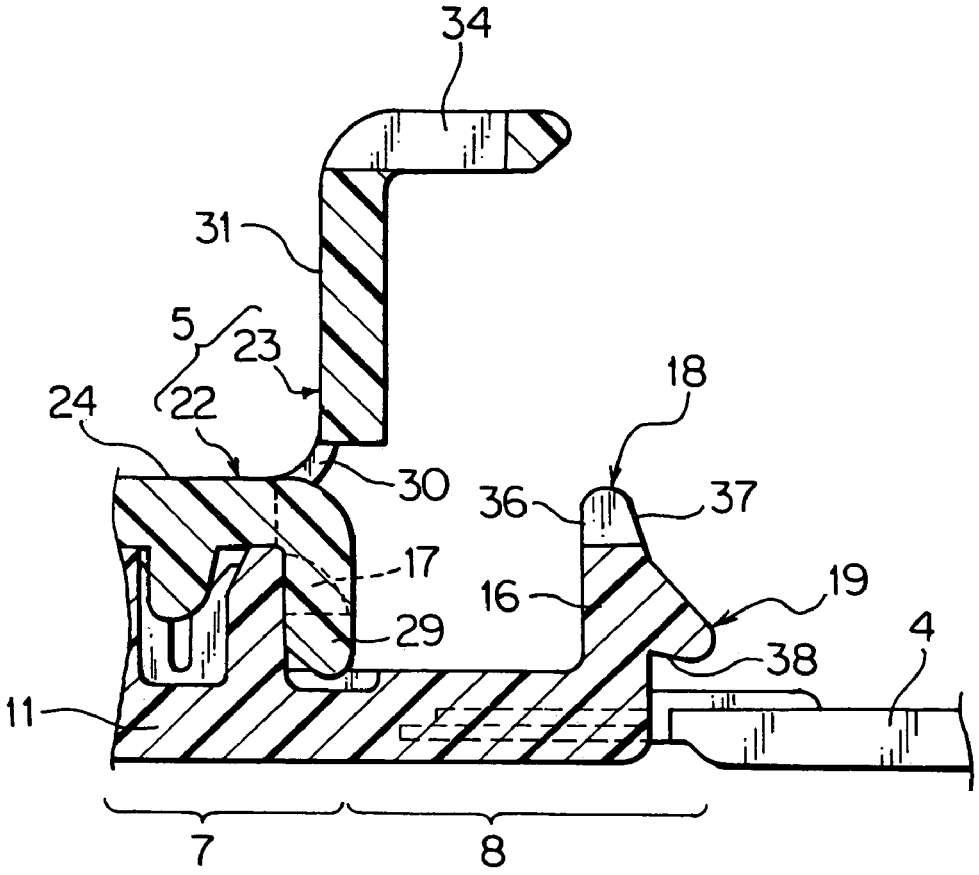
FIG. 4A is a cross-sectional view taking along XA—XA in FIG. 2.
Figure 4B:
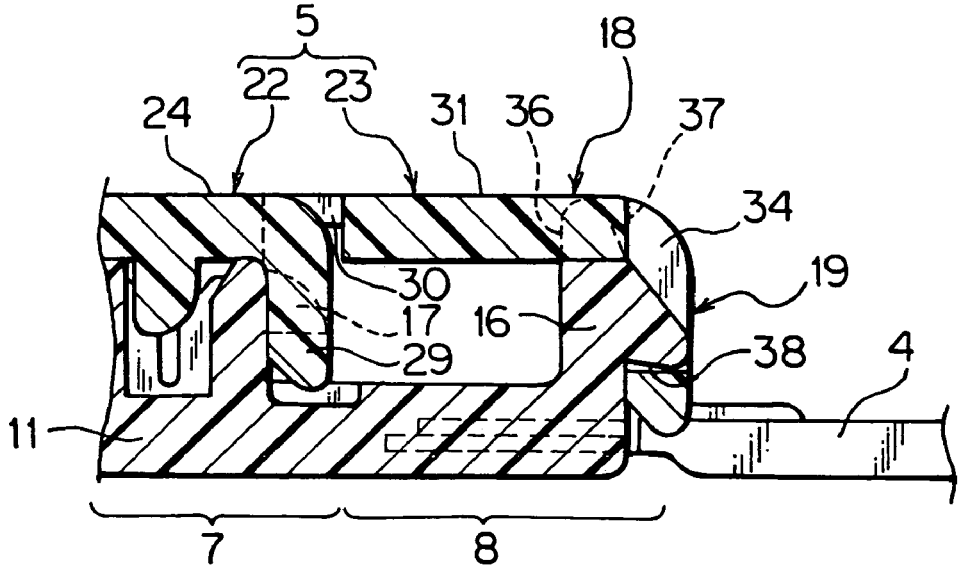
FIG. 4B is a cross-sectional view taking along XB—XB in FIG. 3.
Figure 5A:
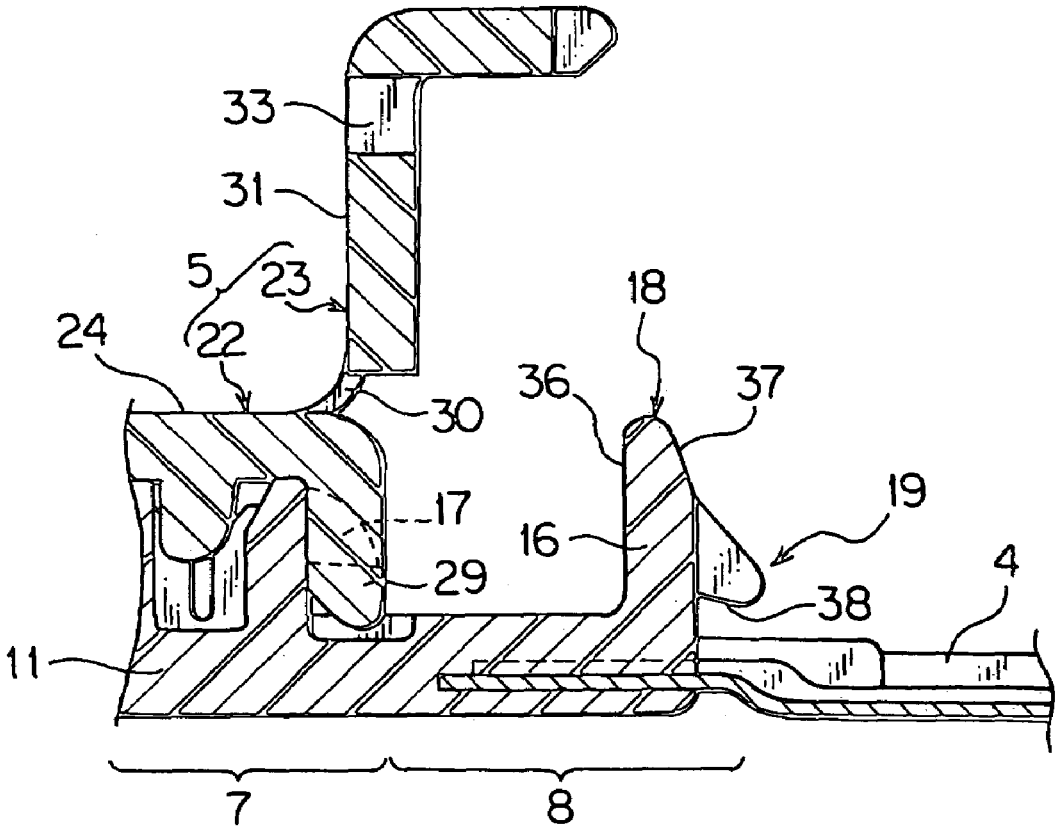
FIG. 5A is a cross-sectional view taking along YA—YA in FIG. 2.
Figure 5B:
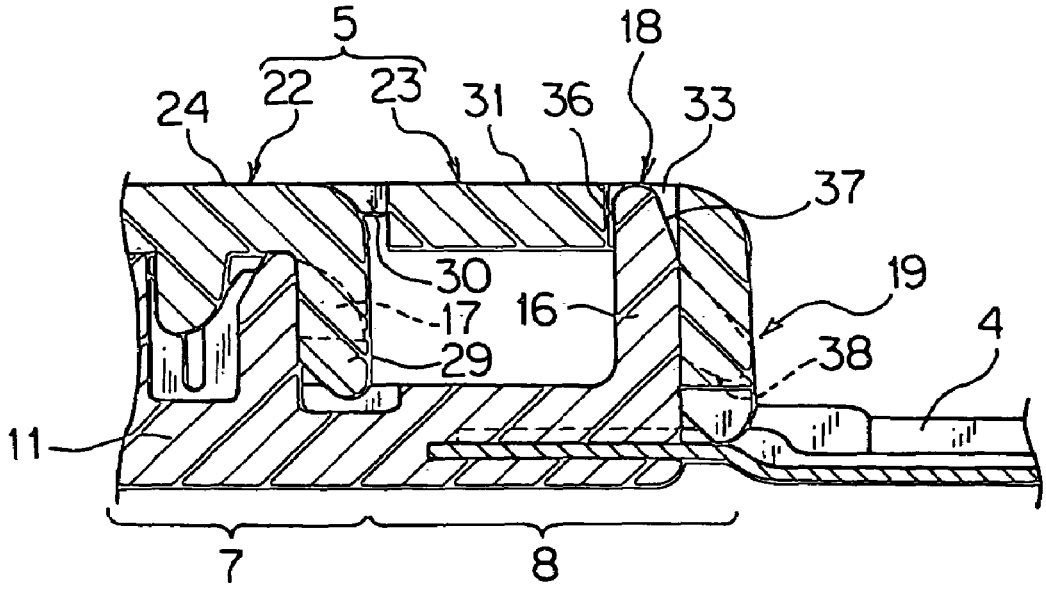
FIG. 5B is a cross-sectional view taking along YB—YB in FIG. 3.

As shown in FIG. 4A, the first lock projection 19 provided at the main box body 2 projects from the outer surface of the front wall 16 along the surface of the bottom wall 11. The surface 38 of the first lock projection 19 in the vicinity of the bottom wall 11 is formed vertical to the front wall 16. As shown in FIG. 5A, the second lock projection 18 projects from the top edge, apart from the bottom wall 11, of the front wall 16 along a surface of the front wall 16. An inner surface 36 of the main box body 2 extends in parallel to the surface of the front wall 16. Thereby, the surface 38 of the first lock projection 19 in the vicinity of the bottom wall 11 intersects with the inner surface 36 of the box man body 2 at the second lock projection 18.

An outer surface 37 of the main box body 2 at the second lock projection 18 is tapered gradually toward an inside of the main box body 2 in accordance with a distance from the bottom wall 11.

The cover 5 includes a large first cover portion 22 for covering the joint portion 7 and a small second cover portion 23 for covering the wire bundle portion 8.

The first cover portion 22 is formed into an L-shape with a horizontal top wall 24 and a vertical rear wall 25. A width of the top wall 24 is slightly narrower than that of the rear wall 25. The electrical wires 9 (FIG. 9) can be led to outside from both of right-and-left edge portions 26. The rear wall 25 is provided with a pair of right-and-left rectangular lock holes 27 corresponding to the lock projections 21 on the rear wall 20 of the main box body 2. The first cover portion 22 has flexible rims 28 close to the lock holes 27. A pair of right-and-left lock rims 29 corresponding to the lock projections 17 on the partition wall 12-1 at the front end of the joint portion 7 is formed downwardly and vertically at a front edge of the top wall 24.

Figure 11:
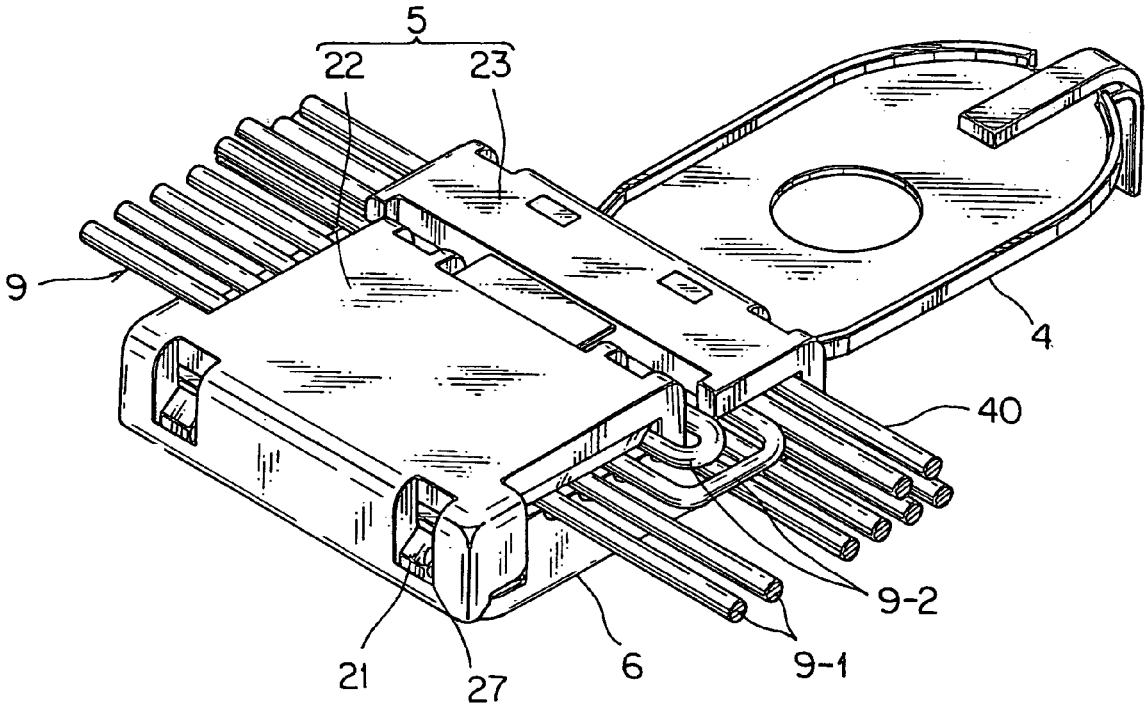
FIG. 11 is a perspective view of the base unit covered by the cover (an electrical wire bundle structure by the joint box)
Figure 12:
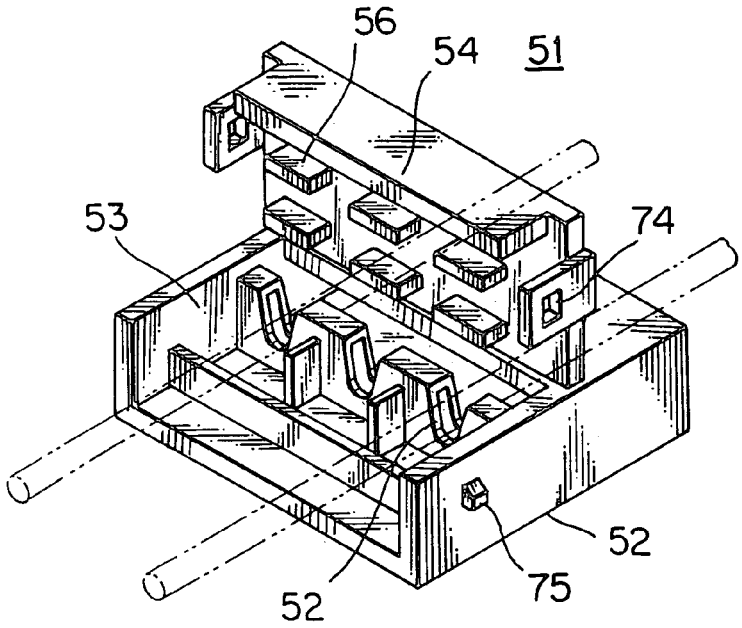
PRIOR ART FIG. 12
FIG. 12 is a perspective view of an example of a joint box by prior art.
Figure 13:
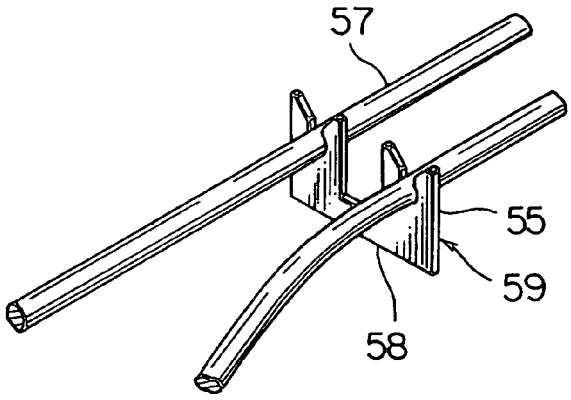
PRIOR ART FIG. 13
FIG. 13 is a perspective view of pressure-contact terminals of a bus bar by prior art in which electrical wires are press-fitted.
Figure 14:
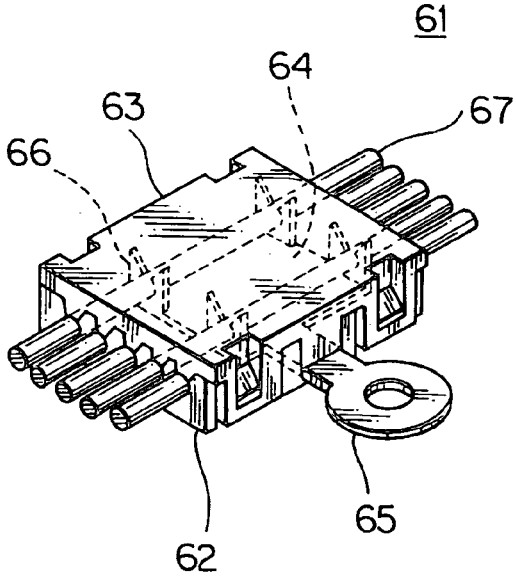
PRIOR ART FIG. 14
FIG. 14 is a perspective view of another example of a joint box by prior art.

A flexible thin hinge 30 is formed integrally with the top wall 24 between the pair of lock rims 29 and at a center of the front edge of the top wall 24. The hinge 30 is connected integrally with the second cover portion 23. The second cover portion 23 can rotate freely about the hinge 30 in open/close directions. In FIG. 11, the second cover portion 23 is closed. Width in a direction perpendicular to a front/rear direction of the second cover portion 23 is wider than that of the top wall 24 of the first cover portion 22 and the same as that of the rear wall 25 of the first cover portion 22.

The second cover portion 23 has a top wall 31, which looks up when closed, and a low front wall 32 continued vertically to a front end of the top wall 31. A rear end of the top wall 31 is continued to the hinge 30. The second cover portion 23 is provided at a front side of the top wall 31 with a pair of right-and-left rectangular second lock holes (second lock portion) 33 corresponding to the second lock projections 18 extending upwardly at the top edge of the front wall 16. The second cover portion 23 is also provided at the front wall 32 with a pair of right-and-left rectangular first lock holes (first lock portion) 34 corresponding to the first lock projections 19 of the front wall 16. A rim 35 surrounding the first lock hole 34 is formed flexible. The front wall 32 has a cutout (not shown) for passing the earth ground terminal 4 therethrough between the rims 35.

The first cover portion 22 of the cover 5 is provided on an inner surface thereof with ribs (not shown) for pressing electrical wires corresponding to respective grooves 10 of the joint portion 7 of the base unit 6 integrally, and recesses (not shown) corresponding to the pressure-contact terminals 3 at a middle in a direction of lengthwise of the rib.

Right/left ends of the respective ribs intersect perpendicularly with ribs 39 extending in a front-to-rear direction at right and left ends of the first cover portion 22. The ribs 39 at right and left ends of the first cover portion 22 go inside the right and left side walls 13 of the base unit 6 for clamping the electrical wires 9 (FIG. 9) between the half-round wire lead-out 14 and them.

The earth ground terminal 4 includes a wide base plate 41, a rim 42 standing around the base plate 41, a hole 43 being opened at the base plate 41 for fixing and a lead 44 being bent downward at a front end of the base plate 41.

Figure 6:
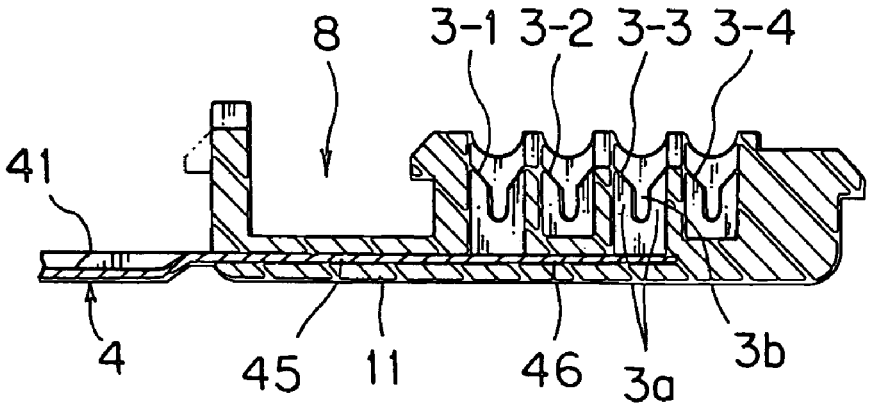
FIG. 6 is a cross-sectional view of a base unit of the joint box in FIG. 1.

FIG. 6 shows a vertical sectional view of the base unit 6. The base plate 41 of the earth ground terminal 4 extends in the bottom wall 11 of the wire bundle portion 8 as an extension 45 being integrally continued to a U-shape first bus bar 46. The first bus bar 46 continues to the pressure-contact terminals 3-1, 3-3 in a first line and a third line from a front side. A second bus bar (not shown), which is the other independent bus bar with an inverted U-shape, continues to the pressure-contact terminals 3-2, 3-4 in a second line and a fourth line from the front side.

The pressure-contact terminal 3 includes a pair of right-and-left contact pieces 3*a* having a blade for cutting a wire cover at a top thereof, and a slot 3*b* for press-fitting the electrical wire between the contact pieces 3*a*.

Each electrical wire 9 is press-fitted into each pressure-contact terminal 3. The pressure-contact terminals 3-2, 3-4 continued to the second bus bar are connected with the electrical wires 9 connected to a positive electrode. The pressure-contact terminals 3-1, 3-3 continued to the first bus bar 46 are connected with the electrical wires 9 connected to a negative electrode and connected through the earth ground terminal 4 with an earth ground of a vehicle body.

The joint box 1 is assembled as followings. The electrical wires 9 are press-fitted into the pressure-contact terminals 3 provided in the joint portion 7 with a predetermined form. By engaging the lock projections 21 and the lock holes 27, and engaging the lock projections 17 and the lock rims 29, the first cover portion 22 is locked on the main box body 2. The other ends of some of the pressure-fitted electrical wires 9 are folded and received at the wire bundle portion 8. Electrical wires 40, which are not press-fitted, are received at the wire bundle portion 8. By rotating the second cover portion 23 about the hinge 30, and engaging the first lock projections 19 and the first lock holes 34, the second lock projections 18 and the second lock holes 33, the second cover portion 23 is locked on the main box body 2.

When the second cover portion 23 is mounted on the main box body 2, the second lock projection 18 is engaged with the second lock hole 33. Since the outer surface 37 of the second lock projection 18 is tapered gradually to the inside of main box body 2 in accordance with a distance from the bottom wall 11, the second cover portion 23 is mounted on the main box body 2 by that the outer surface 37 of the second lock projection 18 is not an obstacle against the second lock hole 33. Thus, the joint box 1 is assembled.

Figure 7:
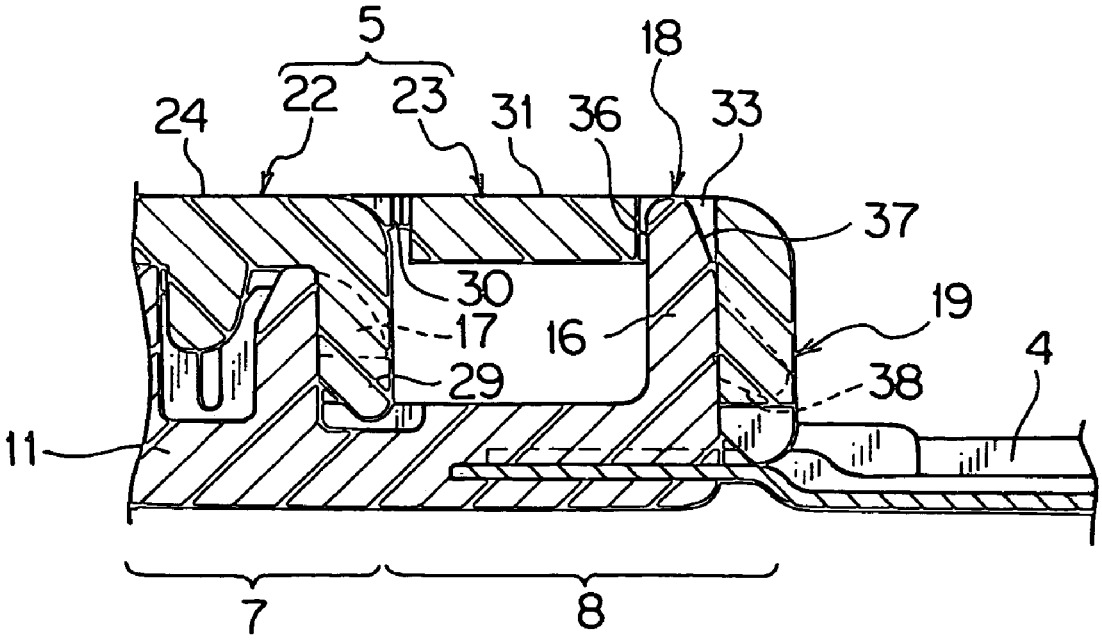
FIG. 7 is a cross-sectional view showing a condition that a hinge shown in FIG. 5B is broken.

When the hinge 30 is broken off to separate the first cover portion 22 and the second cover portion 23 as shown in FIG. 7, the second cover portion 23 is possibly dismounted from the main box body 2. The inner surface 36 of the second lock projection 18 provided at the main box body 2 extends in parallel to the surface of the front wall 16. The surface 38 in the vicinity of the bottom wall 11 of the first lock projection 19 provided at the main box body 2 intersects perpendicularly with the front wall 16. Thereby, The pair of second lock projections 18 provided at the main box body 2 is locked continuously with the pair of second lock hole 33 provided at the second cover portion 23. Also, the first lock projection 19 is locked continuously with the first lock hole 34.

Therefore, when the hinge 30 is broken off, the first cover portion 22 and the second cover portion 23 of the cover 5 are prevented from falling off from the main box body 2.

By connecting the first cover portion 22 and the second cover portion 23, which have different utilities, through the hinge 30, number of components of the cover 5 can be reduced.

In this embodiment, the cover 5 is divided into two covers 22, 23. In the present invention, the cover 5 can be divided into more than two. The plurality of covers can be provided respectively with lock holes and the main box body 2 is provided with lock projections engaged with the lock holes. According to the present invention, at least one of the plurality of the covers is provided with lock holes and the main box body 2 is provided with lock projections engaging with the lock holes.

An electrical wire bundling structure having the above joint box 1 will be described herein.

Figure 8:
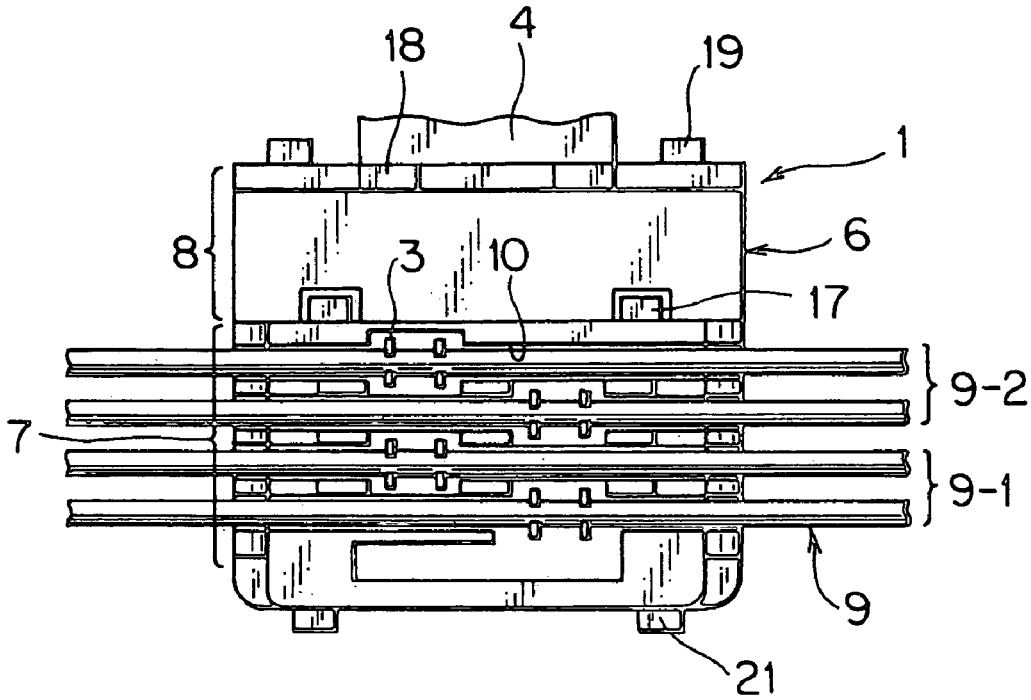
FIG. 8 is a plan view of the base unit, electrical wires wired at a joint portion of the base unit.

As shown in FIG. 8, respective electrical wires 9 is placed in the each groove 10 at the joint portion 7 of the base unit 6 without the cover 5. Each electrical wire 9 is press-fitted into each pressure-contact terminal 3 by a pressure-contact jig (not shown). In this embodiment, one of two rear-half electrical wires 9-1 is connected with the second bus bar as the positive electrode. The other of two rear-half electrical wires 9 is connected with the first bus bar as the positive electrode. One of two front-half electrical wires 9-2 is connected with the second bus bar as the positive electrode, and the other is connected with the first bus bar as the negative electrode, which is continued to the earth ground terminal 4.

After press-fitting the electrical wires 9, only the first cover portion 22 of the cover 5 is secured to cover the joint portion 7 for protecting. The electrical wires 9 are pressed and secured to the main box body 2 by the right/left edges of the first cover portion 22 as mentioned above. Thereby, it is prevented that a pulling force on the electrical wires 9 is transformed to pressure-contact points (connecting points of the pressure-contact terminals 3 and the electrical wires 9). The first cover portion 22 is locked on the main box body 2 by the lock projections 17, 21 and lock hole/rim 27, 29 at the front and the rear of the main box body 2. The second cover portion 23 opens continuously.

After the first cover portion 22 is locked, not-press-fitted electrical wires 40 formed straight and a part of the press-fitted electrical wires 9-2 folded into U-shape are placed at the wire bundle portion of the base unit 6, and the second cover portion 23 is locked. The second cover portion 23 is positioned by the second lock projection 18 and the second lock hole 33, and locked securely by the first lock projection 19 and the first lock hole 34. The electrical wires 40, 9-2 are passed through the wire bundle portion 8, not fixed therein (movable in a direction of lengthwise of the electrical wire and held in a radial direction unmovable). Electrical wires having various diameters can be used as the electrical wires 40.

Thus, the electrical wires 9 to be press-fitted and the electrical wires 40 not to be press-fitted are wired in the joint box 1 and held therein by locking the cover 5. The electrical wires 9, 40 can be bundled in one joint box 1, so that a harness protector by prior art can be eliminated and cost of components is reduced.

Figure 10:
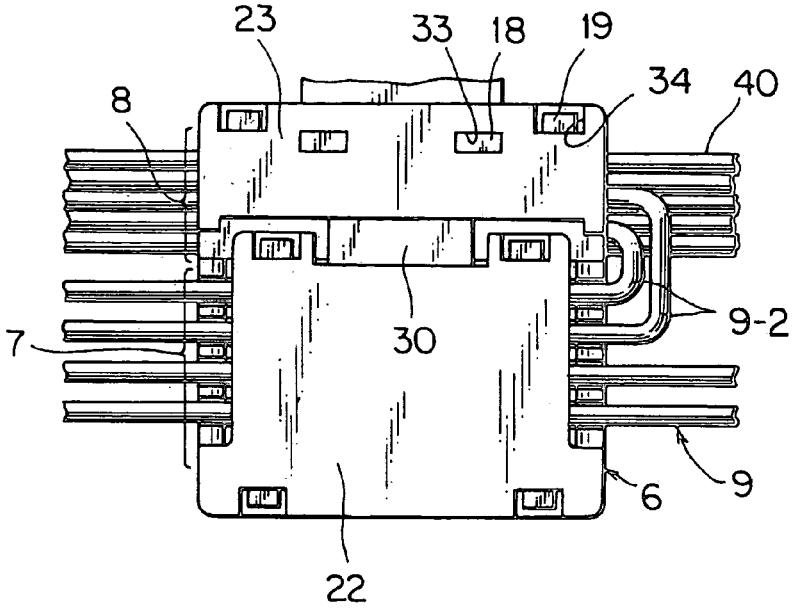
FIG. 10 is a plan view of the base unit, in which the electrical wires are bundled at a wire bundle portion, covered by a second cover portion.

By holding the press-fitted two electrical wires 9-2 folded into U-shape, the directions of leading the four electrical wires 9-2 can be arranged to one direction (left direction in FIG. 10) so as to concentrate a connection with a connector located in the same direction. For example, each two led-out electrical wires 9-2 are connected at the ends thereof with each connector (not shown). The ends of the electrical wires 9-1 can be connected with connectors, which are connected with an apparatus and the other connectors of a wire harness.

The electrical wires 9 to be press-fitted should be secured ideally without moving them from the position of press-fitting them in view of quality. Therefore, according to the present invention, after press-fitting the electrical wires 9, the first cover portion 22 is mounted soon so as to clamp the electrical wires 9 between the joint portion 7 and the first cover portion 22 for preventing loading a tension force on the pressure-contact terminals 3. In the other operation, the other electrical wires 40 are received at the wire bundle portion 8 and the second cover portion 23 is locked.

At the position of press-fitting the electrical wires 9, the press-fitted electrical wires 9 and the electrical wires 40 at the wire bundle portion 8 can be covered at once with a separated cover (not shown) not through the hinge 30. In the press-fitting operation which requires carefulness, any operation unrelated with press-fitting should be separated so that two operations of wiring the electrical wires 9 and 40 are separated in the present invention. The cover 5 by connecting the cover portions 22, 23 through the hinge 30 according to the present invention is effective for such operations.

For covering the joint portion 7 and the wire bundle portion 8 of the base unit 6 at once by the cover 5, after press-fitting the electrical wires 9 at the joint portion 7 and passing the other electrical wires 40 through the wire bundle portion 8, the cover 5 is locked on the base unit 6. Or, after press-fitting the electrical wires 9 at the joint portion 7, and passing the only press-fitted electrical wires 9-2 by folding them into U-shape through the wire bundle portion 8, the cover 5 is locked on the base unit 6. Or, after press-fitting the electrical wires 9 at the joint portion 7, and passing the press-fitted electrical wires 9-2 by folding them into U-shape and the other electrical wires 40 through the wire bundle portion 8, the cover 5 is locked on the base unit 6.

A cover is not limited only the cover 5 with hinge 30 according to this embodiment, but also a cover having one wide wall (not shown). In the cover having one wide wall, the lock projection 17 is not required on the partition wall 12-1 inside the wire bundle portion 8.

According to the above embodiment, the lock projections 17, 19, 21 and lock rim 29 or lock holes 27, 34 are used for locking the cover 5 on the base unit 6. Locking devices are not limited them, and for example, a flexible lock projection or a blind lock hole, a recess, a groove for engaging or a step for engaging can be used. Also, lock projections can be provided on the main box body 2 or the cover 5, and lock holes can be provided on the main box body 2 or the cover 5.

The first cover portion 22 for the joint portion 7 and the second cover portion 23 for the wire bundle portion 8 can be formed separately without the hinge 30. In this case, the cover portions 22 and 23 require respective locking devices (providing lock rims at a rear end of the second cover portion 23) so that a structure thereof becomes complicated and a size thereof becomes larger.

In the above embodiment, two electrical wires 9-1 and two electrical wires 9-2 are arranged adjacently and respective pressure-contact terminals of the first bus bar and the second bus bar are arranged alternately. For arranging one of two electrical wires 9-1 and one of two electrical wires 9-2 alternately, respective pressure-contact terminals 3 of the first bus bar can be arranged adjacently and respective pressure-contact terminals 3 of the second bus bar can be arranged adjacently. Number of the electrical wires 9, 40 and pressure-contact terminals 3 can be determined according to a joint circuit.

The directions of leading the electrical wires 9 from the base unit 6 are not limited two directions of right and left, and can be three directions of right, left and rear. In this case, a wire holding groove (not shown) going rearward and perpendicular to the grooves 10 for holding the electrical wires 9 in the directions of right and left is provided at a rear-half of the joint portion 7, and a pressure-contact terminal is provided in the wire holding groove. The electrical wire 9 is bent perpendicularly and wired and press-fitted in the grooves so as to be led in a perpendicular direction between right and rear or left and rear.

Instead of the ribs 39 of the cover 5, grooves like half-round wire lead-outs 14 of the main box body 2 can be provided at right/left ends of the first cover portion 22 for clamping the electrical wires 9. A diameter of hole combined with the top and bottom half-round wire lead-outs 14 shall be smaller than that of the electrical wires 9.

Instead of the pressure-contact terminal 3, a crimp contact terminal or welding terminal (not shown) can be provided integrally or separately at the bus bar, and instead of press-fitting, core wire (conductive portion) of the electrical wire 9 can be joined with the terminal by crimping or welding. The pressure-contact terminal, the crimp terminal and welding terminal are called a joining terminal generally.

The earth ground terminal 4 cannot be formed only into a flat plate shape, but also a tab shape, a female-shape and the like.

Having now fully described the invention, it will be apparent to one of ordinary skill in the art that many changes and modifications can be made thereto without departing from the scope of the invention as set forth herein.

What is claimed is:

1. A joint box comprising:

a base unit including separately a joint portion having contact terminals for connecting electrical wires with each other and a wire bundle portion absent contact terminals for passing electric wires therethrough, without connecting to any other electrical wires, to bundle the electrical wires; and a cover mounted on the base unit for covering said joint portion and said wire bundle portion, the cover having a first cover portion for the joint portion and a second cover portion, integrally connected to the first cover portion through a hinge, for the wire bundle portion.

2. The joint box according to claim 1, wherein said joint portion and said wire bundle portion are arranged in parallel in a direction perpendicular to the lengthwise direction of the electric wires.

3. An electrical wire bundling structure comprising the joint box according to claim 1, wherein the electrical wires are bundled at the wire bundle portion.

4. An electrical wire bundling structure comprising the joint box according to claim 3, wherein the electrical wires connected with the terminal of the joint portion are folded into U-shape and passed through the wire bundle portion.

5. A joint box comprising:

a base unit including separately a joint portion having contact terminals for connecting electrical wires with each other and a wire bundle portion absent contact terminals for passing electric wires therethrough, without connecting to any other electrical wires, to bundle the electrical wires; and a cover mounted on the base unit for covering said joint portion and said wire bundle portion;

wherein said base unit comprises a main box body having a bottom wall for positioning the electrical wires thereon, a side wall extending vertically from the bottom wall, a first lock projection projecting from an outer surface of the side wall along a surface of the bottom wall and a second lock projection projecting from an edge of the side wall at remote side from the bottom wall along a surface of the side wall, wherein the cover includes a first lock portion for engaging with the first lock projection and a second lock portion for engaging with the second lock projection.

6. The joint box according to claim 5, wherein an inner surface of the second lock projection intersects with a surface of the first lock projection in a vicinity of the bottom wall.

7. The joint box according to claim 6, wherein an outer surface of the second lock projection is tapered gradually toward the inner surface thereof in accordance with a distance from the bottom wall.

8. The joint box according to claim 6, wherein at least one terminal of the joint portion is connected with an earth ground terminal.

9. An electrical wire bundling structure comprising the joint box according to claim 6, wherein the electrical wires are bundled at the wire bundle portion.

10. The joint box according to claim 7, wherein at least one terminal of the joint portion is connected with an earth ground terminal.

11. An electrical wire bundling structure comprising the joint box according to claim 7, wherein the electrical wires are bundled at the wire bundle portion.

12. An electrical wire bundling structure comprising the joint box according to claim 8, wherein the electrical wires are bundled at the wire bundle portion.

13. An electrical wire bundling structure comprising the joint box according to claim 10, wherein the electrical wires are bundled at the wire bundle portion.

14. A joint box, comprising:

a base unit including separately a joint portion having contact terminals for connecting electrical wires with each other and a wire bundle portion absent contact terminals for passing electric wires therethrough, without connecting to any other electrical wires, to bundle the electrical wires; and a cover mounted on the base unit for covering said joint portion and said wire bundle portion;

wherein at least one terminal of the joint portion is connected with an earth ground terminal.

15. An electrical wire bundling structure comprising the joint box according to claim 14, wherein the electrical wires are bundled at the wire bundle portion.

16. An electrical wire bundling structure comprising a base unit including separately a joint portion for connecting electrical wires with each other and a wire bundle portion for passing electric wires therethrough, to bundle the electrical wires; and a cover mounted on the base unit for covering said joint portion and said wire bundle portion; wherein said base unit comprises a main box body having a bottom wall for positioning the electrical wires thereon, a side wall extending vertically from the bottom wall, a first lock projection projecting from an outer surface of the side wall along a surface of the bottom wall and a second lock projection projecting from an edge of the side wall at remote side from the bottom wall along a surface of the side wall, wherein the cover includes a first lock portion for engaging with the first lock projection and a second lock portion for engaging with the second lock projection;

an inner surface of the second lock projection intersects with a surface of the first lock projection in a vicinity of the bottom wall;

the electrical wires are bundled at the wire bundle portion; and the electrical wires connected with each other at the joint portion are folded into U-shape and passed through the wire bundle portion.

17. An electrical wire bundling structure comprising a base unit including separately a joint portion for connecting electrical wires with each other and a wire bundle portion for passing electric wires therethrough, to bundle the electrical wires; and a cover mounted on the base unit for covering said joint portion and said wire bundle portion; wherein said base unit comprises a main box body having a bottom wall for positioning the electrical wires thereon, a side wall extending vertically from the bottom wall, a first lock projection projecting from an outer surface of the side wall along a surface of the bottom wall and a second lock projection projecting from an edge of the side wall at remote side from the bottom wall alone a surface of the side wall, wherein the cover includes a first lock portion for engaging with the first lock projection and a second lock portion for engaging with the second lock projection;

an inner surface of the second lock projection intersects with a surface of the first lock projection in a vicinity of the bottom wall;

an outer surface of the second lock projection is tapered gradually toward the inner surface thereof in accordance with a distance from the bottom wall;

the electrical wires are bundled at the wire bundle portion; and the electrical wires connected with each other at the joint portion are folded into U-shape and passed through the wire bundle portion.

18. An electrical wire bundling structure comprising a base unit including separately a joint portion for connecting electrical wires with each other and a wire bundle portion for passing electric wires therethrough, to bundle the electrical wires; and a cover mounted on the base unit for covering said joint portion and said wire bundle portion; wherein at least one terminal of the joint portion is connected with an earth ground terminal;

the electrical wires are bundled at the wire bundle portion; and the electrical wires connected with each other at the joint portion are folded into U-shape and passed through the wire bundle portion.

19. An electrical wire bundling structure comprising a base unit including separately a joint portion for connecting electrical wires with each other and a wire bundle portion for passing electric wires therethrough, to bundle the electrical wires; and a cover mounted on the base unit for covering said joint portion and said wire bundle portion; wherein said base unit comprises a main box body having a bottom wall for positioning the electrical wires thereon, a side wall extending vertically from the bottom wall, a first lock projection projecting from an outer surface of the side wall alone a surface of the bottom wall and a second lock projection protecting from an edge of the side wall at remote side from the bottom wall alone a surface of the side wall, wherein the cover includes a first lock portion for engaging with the first lock projection and a second lock portion for engaging with the second lock projection;

an inner surface of the second lock projection intersects with a surface of the first lock projection in a vicinity of the bottom wall;

at least one terminal of the joint portion is connected with an earth ground terminal;

the electrical wires are bundled at the wire bundle portion; and the electrical wires connected with each other at the joint portion are folded into U-shape and passed through the wire bundle portion.

20. An electrical wire bundling structure comprising a base unit including separately a joint portion for connecting electrical wires with each other and a wire bundle portion for passing electric wires therethrough, to bundle the electrical wires; and a cover mounted on the base unit for covering said joint portion and said wire bundle portion; wherein said base unit comprises a main box body having a bottom wall for positioning the electrical wires thereon, a side wall extending vertically from the bottom wall, a first lock projection projecting from an outer surface of the side wall alone a surface of the bottom wall and a second lock projection projecting from an edge of the side wall at remote side from the bottom wall along a surface of the side wall, wherein the cover includes a first lock portion for engaging with the first lock projection and a second lock portion for engaging with the second lock projection;

an inner surface of the second lock projection intersects with a surface of the first lock projection in a vicinity of the bottom wall;

an outer surface of the second lock projection is tapered gradually toward the inner surface thereof in accordance with a distance from the bottom wall;

at least one terminal of the joint portion is connected with an earth ground terminal;

the electrical wires are bundled at the wire bundle portion; and the electrical wires connected with each other at the joint portion are folded into U-shape and passed through the wire bundle portion.

* * * * *